US005791135A

United States Patent [19]

Greenberg

[11] Patent Number: 5,791,135

[45] Date of Patent: Aug. 11, 1998

[54] HEAT TREATMENT OF TEXTILE STRANDS PRIOR TO PLYING

[75] Inventor: N. Geoffrey Greenberg, Gastonia, N.C.

[73] Assignee: American & Efird, Inc., Mount Holly, N.C.

[21] Appl. No.: 666,961

[22] Filed: Jun. 20, 1996

[51] Int. Cl.[6] ..... D01H 1/00

[52] U.S. Cl. ..... 57/290; 57/58.52; 28/285

[58] Field of Search ..... 57/290, 58.52, 57/1 R; 28/220, 285, 248, 249, 271, 258

[56] References Cited

U.S. PATENT DOCUMENTS

| | | | |
|---|---|---|---|
| 2,503,242 | 4/1950 | Clarkson | 57/1 R |
| 2,913,802 | 11/1959 | Barnett | 28/76 |
| 4,016,715 | 4/1977 | London, Jr. | 28/258 |
| 4,341,063 | 7/1982 | Southerlin | 28/220 |
| 4,345,424 | 8/1982 | Davis et al. | 57/209 |
| 4,368,612 | 1/1983 | Eschenbach | 28/220 |
| 4,437,301 | 3/1984 | Eschenbach et al. | 57/289 |
| 4,467,594 | 8/1984 | Eschenbach | 28/271 |
| 4,523,441 | 6/1985 | Braybrook et al. | 68/5 |
| 4,590,683 | 5/1986 | Magin | 34/1 |
| 4,943,009 | 7/1990 | Gerstner-Stevens et al. | 242/42 |
| 4,953,368 | 9/1990 | Kawasaki et al. | 28/285 |
| 5,044,150 | 9/1991 | Stahlecker | 57/328 |
| 5,241,844 | 9/1993 | Nakanishi | 28/285 |
| 5,359,759 | 11/1994 | Jacob et al. | 28/271 |

FOREIGN PATENT DOCUMENTS

| | | |
|---|---|---|
| 0072881 | 2/1983 | European Pat. Off. . |

*Primary Examiner*—John P. Darling
*Assistant Examiner*—Tina R. Taylor
*Attorney, Agent, or Firm*—McDonnell Boehnen Hulbert & Berghoff

[57] ABSTRACT

Wound bobbins of yarn are exposed to a high temperature heat treatment step to eliminate variances in hot air shrinkage caused by the manufacturing processes used to make the strands.

10 Claims, 1 Drawing Sheet

HEAT TREATMENT OF TEXTILE STRANDS PRIOR TO PLYING

BACKGROUND OF THE INVENTION

The present invention relates to improvements in processing textile strands, wherein variations in the strands caused by the manufacturing and handling of the strands are significantly reduced or eliminated, thus greatly improving the performance of the finished product incorporating the strands. In particular, this invention yields doubled yarn packages that are free of the vagaries normally found in such plied yarn and which are a result of the inconsistencies in strand manufacturing and the processing steps using the strands to make finished yarns. The improved processing involves the use of a heat treatment step and tension control to produce a doubled yarn package that is more uniform in physical characteristics than was previously possible using known techniques.

In the commercial manufacture of yarns, such as sewing thread, several strands of material are joined and processed to form the finished product. Strands are defined as an ordered assemblage of textile fibers having a high ratio of length to diameter and normally used as a unit. Strands can be composed of all natural materials, i.e. wool or cotton, or synthetics, i.e. polymers synthesized from chemical compounds (e.g. acrylic, nylon, polyester, polyethylene, etc.) or mixtures of the two. This invention involves the use of strands containing at least one synthetic material. Synthetic strands are manufactured using a spinning process wherein fiber-forming substances in the plastic or molten state, or in solution, are forced through the fine orifices in a metallic plate called a spinneret, or jet, at a controlled rate. The solidified filaments formed from the spinnerete are drawn-off by rotating rolls, or godets, and wound onto bobbins or pirns. There are several methods to produce synthetic filamented strands: dry spinning, gel spinning, melt spinning, phase-separation spinning, reaction spinning and wet spinning. Variations in the manufacturing process, such as heating/cooling differences and drawing differences, impart inconsistencies in the strand material that typically appear in widely varying inherent hot air shrinkage. Hot air shrinkage is the reduction in the dimensions of a fabric, yarn, or fiber induced by exposure to dry or wet heat and is a fundamental property of fibers. Once manufactured, these strands are used in the manufacture of yarns, for example sewing threads. The vagaries in the strands are further manifested during the manufacturing steps used to form the finished yarn product.

The following discrete process steps are typically employed during the manufacture of yarns to yield a final end product. First, there is the "spinning" step (to be distinguished from the spinning described above) where strands of cotton, wool and/or synthetic fiber is spun into yarn and wound onto small bobbins. These small bobbins are typically steam treated prior to further processing in a "twist setting" step. The yarn from these small bobbins are wound in serial fashion (i.e., the end of one bobbin is spliced onto the end of the next bobbin) to form larger bobbins or run-off spools of yarn. Several of these run-off spools are then placed on a reel and the yarn from each of the run-off spools are fed or delivered to a "doubling" or "plying" process. In the doubling process two or more yarns from the individual run-off spools are wound together to form a doubled yarn package. Typically, the doubled yarn packages are then used in a "twisting" operation as the final mechanical processing step prior to dyeing and finishing.

As mentioned, the variances in the manufacturing of the strands results in strand material having varying hot air shrinkage. When these strands are processed in the spinning and winding steps during yarn manufacture, and subjected to all the physical handling of the different yarn packages, all of which occurs prior to the strands being used in the doubling process, the resultant finished yarn packages are found to have highly undesirable vagaries. These vagaries ultimately manifest themselves as operational problems when the finished yarns are eventually employed in their designed end use, such as in sewing threads. For example, by the time the strands become part of a run-off spool they may have developed nonuniform and widely varying inherent hot air shrinkages or have hot air shrinkages much greater or less than other run-off spools of the same material. Given the fact that each run-off spool may contain strands having varying physical characteristics, the vagaries are further magnified when the strands from the multiple run-off spools are combined in the doubling process to form the plied yarn of the doubled package.

These compounded inconsistencies of the strands ultimately manifest themselves when the final yarn product is employed by the end user. For example, if the yarn being manufactured is a sewing thread, then the variances in the physical characteristics of the strands manifest themselves as inconsistency in the stitch balance. This is typically observed by the sewing machine operator as random loops on the underside of the sewn material. In attempting to correct stitch imbalance, the sewing machine operator will typically increase the tension on the sewing machine. This increased tension can result in skipped stitches and as the tension is further increased can eventually cause thread breakage. Skipped stitches and thread breakage are economically unacceptable to garment manufacturers. Unfortunately, the variances in the final yarn products, caused by the vagaries inherent in the strands, can only be detected when the yarn is put to its actual end use. Conventional physical examination of the plied yarn or the final yarn product does not typically reveal the inherent vagaries caused by the manufacturing of the strands and the manufacturing steps employing the strands to make finished yarns. The only accurate way to measure the vagaries is by statistically measuring the finished yarn under actual commercial use. For example, an electronic data collection system can be used to measure the number of work pieces sewn per stitch break.

Yarn manufacturers have recognized for some time the need to try and eliminate the obvious variances caused by the different processes and handling steps that occur during the manufacture of yarn. For example, there is a number of patents directed to devices for spools of yarn obtained after the spinning. U.S. Pat. No. 4,523,441 (Braybrook et al.) teaches a method to reduce or regulate the quantity of fly or lint from production yarn by providing an apparatus that introduces humidity to a flow of air that impinges on textile yarn being wound or unwound. Another example are the methods and apparatuses for steam-setting bobbins of yarn produced by a spinning process as disclosed in U.S. Pat. Nos. 4,953,368 (Kawascki et al.) and 5,291,757 (Wanger). Likewise, the art has made attempts to improve the doubling process by including yarn guides or prestrengthening devices or detectors to determine when a yarn breaks. In U.S. Pat. No. 5,044,150 (Stahlecker) yarn detectors indicate broken yarn, stopping the process and activating an automatic piecing device to reconnect the yarn. U.S. Pat. No. 4,943,009 (Gerstner-Stevens et al.) discloses an improved plying process wherein a sensor is employed to detect the presence and absence of threads along a predetermined path. This sensor allows for automating the binding together of thread with a new spool when a given run-off spool becomes empty.

The combined teaching of the art, however, has not recognized that the variances in the physical properties of the strands themselves as a result of the manufacturing steps use to make the strands combined with the mechanical manipulations that occurs during yarn manufacture. The combined effect causes operational problems in the end use of the finished yarn product. Likewise, the art has not discovered that a high temperature thermal treatment of the strands prior to being plied in a doubling process, with controlled tensioning, results in a greatly improved doubled yarn and dramatically increased performance of the ultimate finished yarn product.

BRIEF DESCRIPTION OF THE DRAWING

The drawing is a schematic illustration of one embodiment of the process of the invention.

SUMMARY OF THE INVENTION

Figure 1:
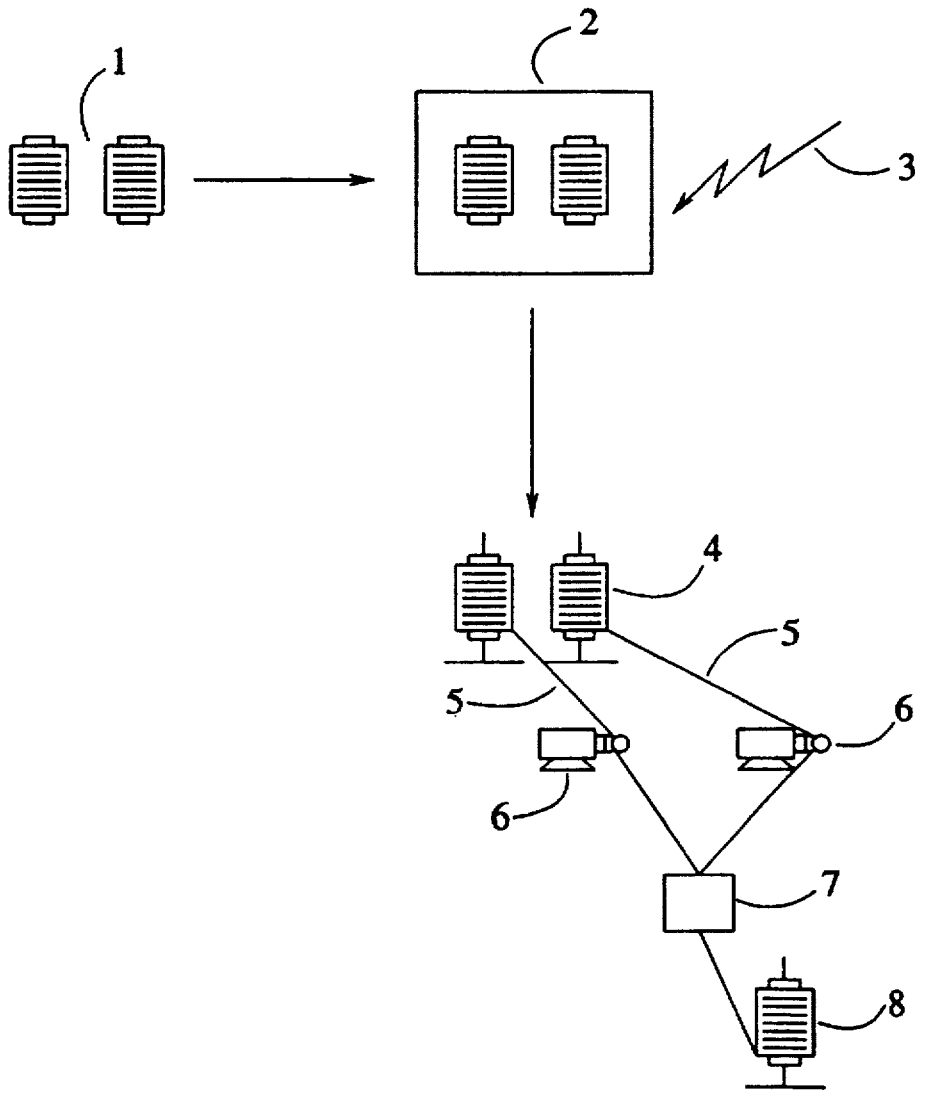

The present invention was developed to overcome the defects and vagaries inherently present in strands used in the manufacturing of commercial yarns, such as sewing threads. As used herein the term "strand" is meant to include any material having at least two synthetic filaments, or synthetic fibers, comprising acrylic, nylon, polyester, polyethylene or mixtures thereof. Likewise, the term "yarn" is used herein to mean any material having at least one strand containing synthetic fibers. An object of this invention is to provide an improved method for processing strands that are used in the manufacture of commercial yarns. Another object is to provide processing steps that remove or eliminate the inherent vagaries in the physical properties of strands that are caused by the variations in the manufacturing process used to make the strands. Yet another object is to provide an improved process for producing doubled or plied yarns from multiple bobbins of yarn comprising strands. Another object is to produce doubled yarn that can be further processed in a conventional twisting apparatus and then finished and dyed without special handling. Still a further object is to produce an improved doubled yarn that when finished, and ultimately used, results in significantly less defects, such as skipped stitches, thread breakage and puckering.

To achieve these objects, the process of this invention involves a high temperature heat treatment step applied to the strands where at least two feed bobbins of yarn comprising strands is heated to a temperature of at least 220° F. This temperature treatment is performed at a pressure above atmospheric. Another embodiment of this invention involves heat treating at least two feed bobbins of yarn to a temperature of at least 220° F.; delivering the yarn from the feed bobbins to a plurality of constant tensioning devices equal in number to the number of feed bobbins; delivering the yarn from each constant tensioning device to a doubling machine at substantially the same constant tension; and combining the yarns from each constant tensioning device in the doubling machine to produce a single double yarn package.

The yarns used in the method of this invention can be a composite of natural and synthetic materials, for example a synthetic filament yarn. Such a yarn is composed of at least one strand and contains any of the following materials: cotton, wool, or synthetic fiber, such as continuous nylon, polyester filament or mixtures thereof. The diameter or tex size of the yarn is not a critical feature of the invention and can vary from tex size of about 18 to about 300. A tex size is defined as a unit for expressing linear density, equal to the weight in grams of 1 kilometer of yarn, filament, fiber, or other textile strand.

In a preferred embodiment of this invention the heat treatment step is carried out using feed bobbins, i.e. those bobbins obtained upon completion of the winding step and which are ready for plying using a conventional doubling machine. Typically, the feed bobbins are formed by the serial combination of yarns in a winding machine using steam-treated bobbins of yarn obtained upon completion of the spinning step.

One of the key features of the present invention is that at least one heat treatment step is performed on the bobbins of yarn before they are used in the doubling machine to form the doubled yarn. These bobbins will be referred to herein as "feed bobbins." This heat treatment step can be carried out in either a continuous or batchwise manner. Preferably, multiple bobbins obtained from the winding step are subjected to a temperature of at least 220° F. for a time sufficient to heat the yarn to the desired temperature. The heating time is obviously a function of the type of yarn, the size and quantity of the yarn bobbins and the particular device used for heating. Heating can be carried out using devices known to the art including direct dryers, indirect dryers, microwave dryers and infrared or radiant dryers. A preferred dryer of this invention is an autoclave that can satisfactorily heat treat up to approximately 150 bobbins at a time. To achieve the desired temperature of at least 220° F. the bobbins must be kept in the autoclave for about 60 minutes at a pressure greater than atmospheric. Depending on heating equipment utilized, the heat treating can be as short as several minutes, preferably at least 30 minutes and most preferably for a time necessary to obtain a surface temperature of the yarn, as measured by a thermocouple, equal to or greater than 220° F.

A distinction must be made between the high temperature heat treating of this invention and the twist-setting (or steam-setting) step typically performed on yarn obtained from the spinning process. Twist-setting is a process that uses steam for fixing twist in yarns to deaden torque and eliminate kinking during further processing. The difference is that in the twist-setting step the steamer is operated at or below atmospheric pressure, at temperatures less than 200° F. and at an elevated humidity. In addition to deadening the torque, twist setting improves the performance of the winding process by allowing for automatic joining of yarn ends as each new small spinning bobbin is added to the winding machine. In the present invention, however, the high temperature heat treatment step is used to equalize the vagaries in the hot air shrinkages that are inherent in the bobbins as a result of the variations in the manufacturing and process handling of the strands. The heat treating of all the bobbins of yarn used to prepare the plied yarn via the doubling machine equalizes the hot air shrinkage of the strands making up the feed bobbins. The overall result is that each strand of yarn taken from the feed bobbins will have approximately the same low average hot air shrinkage. Without the heat treating step of this invention, strands of unequal hot air shrinkage would be plied together to make a doubled yarn. When this doubled yarn is subsequently subjected to the temperatures used in the dyeing process, the different hot air shrinkages of the strands would try to equalize resulting in a finished yarn with unequal tension caused by segments of the yarn having loose strands plied together with tight strands. These loose strands ultimately show up as stitch imbalance in the case where the finished yarn is used as a sewing thread.

Although the absolute value of the average hot air shrinkage of the strands is not critical to the invention, as it will be highly dependent on the starting materials used and the desired end product to be made, it is necessary to achieve a consistent hot air shrinkage in a given strand and in comparison to other like strands of the same material. A typical range of hot air shrinkage for yarns not receiving the heat treatment of this invention would be from about 2% to about 9%. One goal of the heat treatment step is to ensure that each feed bobbin used on the doubling machine should have a consistent hot air shrinkage throughout the bobbin and that each feed bobbin used to form the plied yarn has approximately the same average hot air shrinkage ratio. This will ensure that the doubled yarn formed in the doubling machine will likewise have a uniform and consistent hot air shrinkage.

Another aspect involved in preparing an improved doubled yarn according to this invention is in the use of constant tensioning devices to deliver the yarn from the feed bobbins to the doubling machine. The constant tensioning device can be any device that accepts yarn from a feed bobbin and delivers it to the doubling machine at a relatively constant tension. Tensions are expressed in grams and typically are in a range from about 5 g to about 40 g. Because one of the objects of the invention is to deliver each of the yarn strands utilized by the doubling machine at a constant and uniform tension, it is imperative that a separate constant tensioning device be associated with each feed bobbin. Because as many as six feed bobbins can be used at one time as a source of yarn to the doubling machine, this requires an equal number of constant tensioning devices to be placed between the feed bobbins and the doubling machine to control the tension of each yarn strand. A preferred constant tensioning device is one that has been used in the weaving industry on looms to assist in the delivery weft yarn at a constant tension to the warp.

In using the preferred constant tensioning device of this invention the yarn strand from the feed bobbin is wrapped multiple times, preferably at least twenty times, around the barrel of the constant tensioning device and then placed in contact with a brush before joining the other yarn strands in the doubling machine. The tension of each yarn strand delivered from the constant tensioning devices to the doubling machine is measured and compared to the tension of the other yarn strands being delivered from the other constant tensioning devices. To ensure that all of the yarn strands are at approximately the same average tension, adjustments are made to the constant tensioning devices by moving the brushes associated with each constant tensioning device relative to the barrel of the constant tensioning device. This has the desired affect of increasing or decreasing the tension as necessary to put it in line with the average tension of the other strands making up the plied yarn. The brush associated with each constant tensioning device also serves to prevent ballooning of the strand as it is being fed to the doubling machine.

The doubling machine used in the process of this invention can be any of the machines well known to yarn manufacturing industry that is capable of plying two or more strands of yarn to form a composite doubled yarn package. Examples of the types of doubling machine that can be used in this invention are disclosed in U.S. Pat. Nos. 4,943,009 and 5,044,150, the teaching of both being incorporated herein by reference.

Referring now to the drawing, there is shown at least two wound feed bobbins of textile yarn 1 being introduced into a heating device 2. The wound bobbins 1 are subjected to heat 3 for a predetermined time and thereafter removed from heating device 2. The strands 5 from the heated wound feed bobbins 4 are then delivered at ambient temperature to constant tensioning devices 6 and thereafter to a doubling machine 7 to produce a single bobbin of plied yarn 8.

To further illustrate the improved doubling process of this invention the following example is presented to illustrate an embodiment of the invention and is not in any way limiting of the scope of the invention.

EXAMPLE

Using an electronic data collection apparatus to measure the average number of jean pockets sewn per thread break, a sewing thread, designated as Sample X, was made in accordance with invention described above using an autoclave temperature of 230° F. Testing of this sewing thread resulted in an average of 700 pockets per thread break being sewed. To test and evaluate the affects of using a constant tensioning device, a second sewing thread was manufactured, Sample A, using the identical manufacturing steps used to manufacture Sample X, except that a constant tensioning device was not used. Test results indicated that Sample A was capable of sewing only an average of 420 pockets per thread break. Another test was performed to evaluate the combined affects of the constant tensioning and heat treatment steps. A third sewing thread was manufactured, Sample B, in an identical manner to that of Sample A, except that no heat treatment or constant tensioning was performed. Test results showed that Sample B was capable of sewing only an average of 140 pockets per thread break.

It will be understood that the details given herein are for the purpose of illustration, not restriction, and that variations within the spirit of the invention are intended to be included in the scope of the following claims.

I claim:

1. A method for processing strands comprising heat treating at least two wound feed bobbins of yarn to a temperature of at least 220° F. after a winding step but prior to plying at ambient temperature.

2. The method of claim 1 wherein the heat treating temperature is at least 265° F.

3. A method for processing strands comprising, in combination, the following steps;

(a) heat treating at least two feed bobbins of yarn after winding to a temperature of at least 220° F.;

(b) delivering at ambient temperature the heat treated wound feed bobbins of yarn to a doubling process; and (c) forming a single bobbin of plied yarn.

4. A process for producing doubled yarn comprising, in combination, the following steps, (a) heat treating at least two wound feed bobbins of yarn after winding to a temperature of at least 220° F.;

(b) delivering the heat treated yarn from each of the feed bobbins to a plurality of constant tensioning devices equal in number to the number of feed bobbins;

(c) delivering at ambient temperature the yarn from each constant tensioning device to a doubling machine at substantially the same tension; and (d) combining the yarns from each constant tensioning device in the doubling machine to produce a single doubled yarn package.

5. The process of claim 4 wherein the heating of the wound feed bobbins in step (a) is carried out for at least 30 minutes and at a pressure greater than atmospheric.

6. The process of claim 5 wherein the heat treating is carried out as a noncontinuous batch operation.

7. The process of claim 4 wherein the substantially same tension of all the yarns is achieved by measuring the tension of each yarn delivered and adjusting brushes on the constant tensioning devices.

8. The process of claim 4 further comprising heating the wound feed bobbins to a temperature of at least 265° F.

9. A process for producing an improved sewing thread where a doubling process comprising, in combination, the following steps is used, (a) heat treating at least two wound feed bobbins of yarn having a tex size ranging from about 18 to about 300 after winding to a temperature of at least 220° F.;

(b) delivering at ambient temperature the heat treated yarn from each of the feed bobbins to a plurality of constant tensioning devices equal in number to the number of feed bobbins;

(c) delivering the yarn from each constant tensioning device to a doubling machine at substantially the same tension; and (d) combining the yarns from each constant tensioning device in the doubling machine to produce a single doubled yarn package.

10. A method for manufacturing a sewing thread comprising, in combination, the following steps:

(a) spinning yarn to produce a plurality of small bobbins;

(b) winding the small bobbins to form run-off spools;

(c) heat treating the run-off spools to a temperature of at least 220° F.;

(d) plying the heat treated yarn from step (c) to form single packages of doubled yarn;

(e) twisting the plied yarn from step (d); and (f) dying and finishing the twisted yarn of step (e) to produce sewing thread.

* * * * *